US011551920B2

(12) United States Patent
Furuta

(10) Patent No.: US 11,551,920 B2
(45) Date of Patent: Jan. 10, 2023

(54) MASS SPECTROMETER

(71) Applicant: SHIMADZU CORPORATION, Kyoto (JP)

(72) Inventor: Masaji Furuta, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 141 days.

(21) Appl. No.: 16/492,270

(22) PCT Filed: Mar. 5, 2018

(86) PCT No.: PCT/JP2018/008215
§ 371 (c)(1),
(2) Date: Sep. 9, 2019

(87) PCT Pub. No.: WO2018/164025
PCT Pub. Date: Sep. 13, 2018

(65) Prior Publication Data

US 2021/0202227 A1 Jul. 1, 2021

(30) Foreign Application Priority Data

Mar. 10, 2017 (JP) ..... JP2017-046338

(51) Int. Cl.
*H01J 49/04* (2006.01)
*B08B 5/02* (2006.01)
(Continued)

(52) U.S. Cl.
CPC ..... *H01J 49/0418* (2013.01); *B08B 5/02* (2013.01); *B08B 5/04* (2013.01); *H01J 49/0495* (2013.01); *H01J 49/164* (2013.01)

(58) Field of Classification Search
None
See application file for complete search history.

(56) References Cited

U.S. PATENT DOCUMENTS

RE39,353 E * 10/2006 Vestal ..... H01J 49/164 250/281
9,214,323 B1 * 12/2015 Vestal ..... H01J 49/0413
(Continued)

FOREIGN PATENT DOCUMENTS

CN 103797559 A 5/2014
JP 2009-54441 A 3/2009
(Continued)

OTHER PUBLICATIONS

The State Intellectual Property Office of the P.R. of China Communication dated Apr. 2, 2021, issued in Application No. 201880017300.7.
(Continued)

*Primary Examiner* — Michael J Logie
(74) *Attorney, Agent, or Firm* — Sughrue Mion, PLLC

(57) ABSTRACT

A mass spectrometer provided with an ionization chamber (10) in which ionization is performed on a sample by laser ionization, includes an opening part (12) that is provided on a side wall of the ionization chamber (10), and includes a door (13); a ventilation port (14) provided in a wall of the ionization chamber (10), which is opposite to the opening port (12); and a gas supplier (64), (67) for supplying high-pressure cleaning gas to the ionization chamber (10) through the ventilation port (14). In this configuration, the high-pressure cleaning gas flows into the ionization chamber (10) from the gas supplier (64), (67) while the door (13) is opened, thereby blowing up particles including fragments of bacterial cells, which are piled up on a floor of the ionization chamber (10), and/or sweeping particles floating near the floor, so as to discharge the particles to the outside.

7 Claims, 4 Drawing Sheets

(51) Int. Cl.
*B08B 5/04* (2006.01)
*H01J 49/16* (2006.01)

(56) References Cited

U.S. PATENT DOCUMENTS

| | | | | |
|---|---|---|---|---|
| 2008/0272286 | A1 | 11/2008 | Vestal | |
| 2012/0132799 | A1* | 5/2012 | Takahashi | H01J 49/0004 250/288 |
| 2012/0312980 | A1* | 12/2012 | Whitehouse | H01J 49/145 250/282 |
| 2015/0380229 | A1 | 12/2015 | Harada | |

FOREIGN PATENT DOCUMENTS

| | | | | |
|---|---|---|---|---|
| JP | 2013-190315 | A | | 9/2013 |
| JP | 2014134420 | A | * | 7/2014 |
| JP | 3205635 | U | * | 8/2016 |
| WO | 2012/167183 | A1 | | 12/2012 |
| WO | 2014/171378 | A1 | | 10/2014 |

OTHER PUBLICATIONS

International Search Report for PCT/JP2018/008215 dated May 29, 2018 [PCT/ISA/210].
Written Opinion for PCT/JP2018/008215 dated May 29, 2018 [PCT/ISA/237].
Extended European Search Report dated Feb. 13, 2020, issued by the European Patent Office in application No. 18764468.7.
Office Action dated Mar. 9, 2022 in Chinese Application No. 201880017300.7.
Notice of Allowance dated Aug. 9, 2022 issued in Chinese Patent Application No. 201880017300.7.

* cited by examiner

MASS SPECTROMETER

CROSS REFERENCE TO RELATED APPLICATIONS

This application is a National Stage of International Application No. PCT/JP2018/008215 filed Mar. 5, 2018, claiming priority based on Japanese Patent Application No. 2017-046338 filed Mar. 10, 2017.

TECHNICAL FIELD

The present invention relates to a mass spectrometer, and in particular to a mass spectrometer that performs ionization (laser ionization) on samples by laser beams.

BACKGROUND ART

As the laser ionization method in a mass spectrometer, a matrix assisted laser deposition/ionization method (MALDI) is widely known. In the MALDI, a target material to be analyzed is mixed with a compound called a matrix, and then the mixture is applied to a metal plate called a sample plate, to be irradiated with a pulsed laser beam in an ionization chamber, so that the ionization is performed. Due to the irradiation with the laser beam, the matrix absorbing the laser beam is rapidly heated, and thus is vaporized. Along with the vaporization, sample molecules are desorbed and ionized.

In other words, the MALDI is one of the moderate ionization methods in which the energy absorbed by the matrix is indirectly received by a sample. Thus, in the MALDI, macromolecules can be ionized without being fragmented. As a result of such performance, a mass spectrometer that performs the ionization with the MALDI (hereinafter, referred to as MALDI-MS) has been used even for the identification of microorganisms, in recent years. The mass spectra obtained by analyzing microorganisms with the MALDI-MS show unique patterns each associated with the corresponding one of the taxonomic groups (genus, species, strains, and so on) of the microorganisms. Accordingly, the taxonomic group of the target microorganism can be identified by performing pattern matching on the mass spectra obtained by analyzing the target microorganisms with mass spectra of the known microorganisms

CITATION LIST

Patent Literature

Patent Literature 1: WO 2014/171378 A (paragraph [0003] and FIG. 3)

SUMMARY OF INVENTION

Technical Problem

When microorganisms are identified using such a MALDI-MS, an extract from bacterial cells is used as the target sample to be analyzed. In addition, bacterial cells scratched from a colony and the suspension of bacterial cells can also be used as the target sample. However, if such bacterial cells that are not broken are used as the sample for the ionization with the MALDI, the bacterial cells are collapsed by the irradiation with a laser beam, and fragments of the collapsed bacterial cells are often scattered over the floor of an ionization chamber. Thus, the fragments of the samples, which are piled on the floor of the ionization chamber, need to be regularly removed. However, the removal requires the apparatus to be disassembled, and thus takes much time and trouble.

Patent Literature 1 discloses amass spectrometer having the mechanism in which an ionization chamber is prevented from being contaminated by minute particles generated at the ionization by a MALDI. Such a mass spectrometer includes a gas-discharge pipe formed in an upper part of the housing of the ionization chamber, and a fan placed inside the gas-discharge pipe for drawing air in the housing into the gas-discharge pipe. The fan is driven to absorb the air containing the minute particles generated from a sample and to send the air to the gas-discharge pipe, thereby discharging the air to the outside of the housing. In such a configuration, the minute particles which have relatively light weight and float inside the ionization chamber for a long time can be removed. However, particles having relatively heavy weight, such as fragments of the bacterial cells, quickly fall on the floor after the generation, and thus cannot be removed.

Although the MALDI-MS is described as an example, such problems are common to all mass spectrometers that perform the laser ionization.

The present invention has been made in view of the aforementioned problems. A purpose of the present invention is to enable fragments of bacterial cells and such particles remaining inside an ionization chamber to be easily removed, in a mass spectrometer that performs laser ionization.

Solution to Problem

The present invention developed for solving the previously described problem is a mass spectrometer that includes:

a) an ionization chamber in which ionization is performed on a sample by laser ionization;

b) an opening part provided on a side wall of the ionization chamber, the opening part including a door;

c) a ventilation port provided on a wall of the ionization chamber, the wall being opposite to the opening part; and d) a gas supplier configured to supply high-pressure gas to an inside of the ionization chamber through the ventilation port.

Here, the laser ionization is a method for ionizing a sample by applying a laser beam to the sample. The method includes the MALDI method, a surface-assisted laser desorption/ionization method, such as a method of desorption/ionization on silicon, and other various laser ionization methods, all of which use laser beams. Furthermore, the high-pressure gas means a gas having a pressure higher than atmospheric pressure. The types of gas are not limited. For example, air or nitrogen can be used as the gas.

The mass spectrometer according to the present invention has the aforementioned configuration, such that the high-pressure gas is introduced from the gas supplier into the ionization chamber through the ventilation port in the state where the door is opened. The gas blows away particles existing on or near the floor of the ionization chamber and discharges the particles toward the outside of the ionization chamber through the opening part that is opened. Accordingly, particles accumulated inside the ionization chamber as well as those floating near the floor of the ionization chamber can be removed without disassembling the ionization chamber.

It is preferable for the mass spectrometer according to the present invention that the opening part is a plate gateway for taking the sample plate to which a sample is applied in and out of the ionization chamber.

With such a configuration, the particles blown away by the high-pressure gas can be discharged to the outside through the plate gateway that is conventionally provided in the ionization chamber. Accordingly, there is no need to newly provide an opening part for discharging the particles, thereby enabling the configuration at a low cost.

It is preferable for the mass spectrometer according to the present invention to further include:

e) a vacuum pump configured to discharge gas from the ionization chamber; and f) a switch section configured to switch states including a state where the vacuum pump communicates with the ionization chamber through the ventilation port and a state where the gas supplier communicates with the ionization chamber through the ventilation port.

The mass spectrometer has conventionally had a vacuum pump for evacuating the ionization chamber. The air inside the ionization chamber is absorbed by the vacuum pump through the ventilation port provided in the ionization chamber. The mass spectrometer according to the present invention, which has the aforementioned configuration, uses the ventilation port conventionally provided in the mass spectrometer for evacuation, for introduction of the aforementioned high-pressure gas. With such a configuration, there is no need to newly provide a ventilation port for the introduction of the high-pressure gas, thereby enabling the configuration at a low cost.

The present invention developed for solving the previously described problem may be the mass spectrometer that further includes:

g) a door driver configured to open and close the door; and h) a controller configured to control the door driver and the gas supplier (or the door driver and the switch section) so that the high-pressure gas is supplied by the gas supplier in a state where the door is opened.

According to the configuration, the opening and closing of the door in the opening part as well as the supply and suspension of the supply of the high-pressure gas to the ionization chamber can be automatically conducted by the apparatus, thereby further reducing the workload, on a user, of removing particles from the ionization chamber.

Advantageous Effects of Invention

As aforementioned, according to the mass spectrometer of the present invention, particles remaining inside an ionization chamber can be easily removed.

DESCRIPTION OF EMBODIMENTS

Embodiments of the present invention are described hereinafter, with reference to the drawings.

Figure 1:
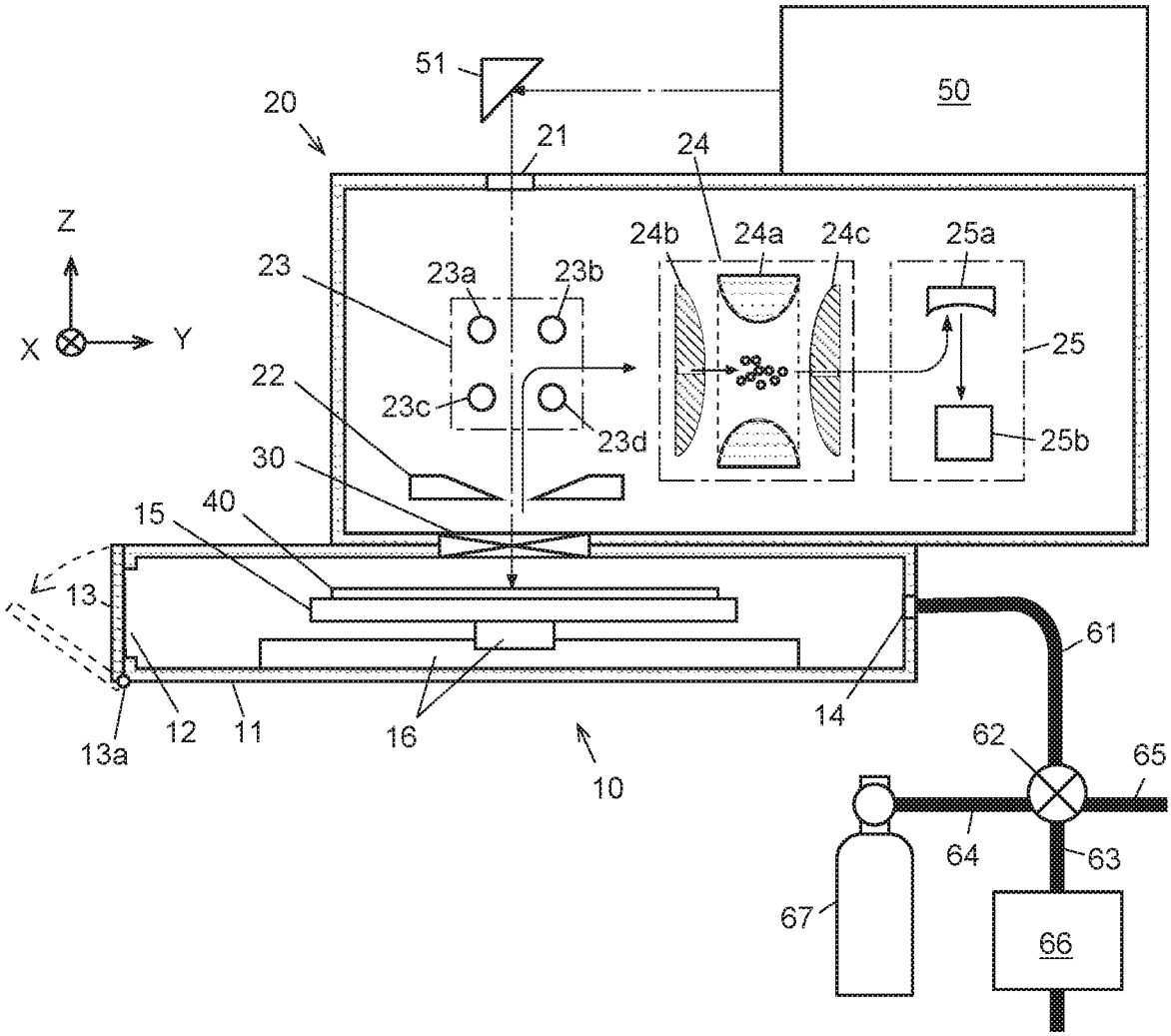
FIG. 1 is a schematic diagram of the entire configuration of a mass spectrometer according to an embodiment of the present invention.

FIG. 1 is a schematic diagram of the entire configuration of a mass spectrometer according to an embodiment of the present invention. The mass spectrometer according to the present embodiment has an ionization chamber 10 and an analysis chamber 20. The inside of each of the ionization chamber 10 and an analysis chamber 20 is maintained at the predetermined degree of vacuum when a sample is analyzed. A gate valve 30 is provided between the ionization chamber 10 and the analysis chamber 20.

Figure 2:
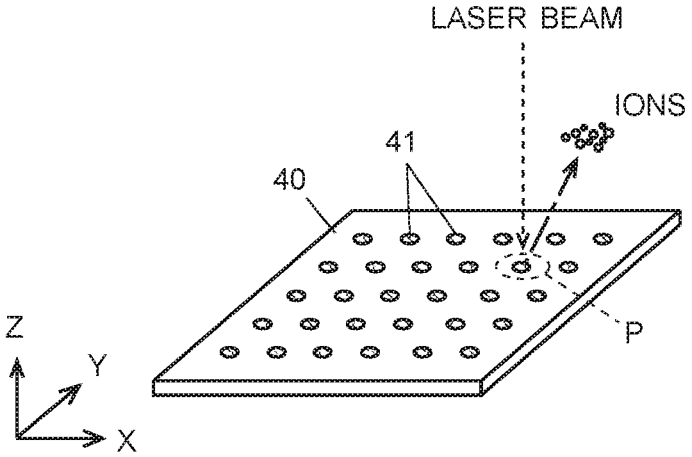
FIG. 2 is a perspective view of a sample plate used in the present embodiment.

When samples are analyzed, the mixture of the sample and a matrix is applied to a plurality of spots on a thin-plate shaped sample plate 40 (several hundred spots when a large number of spots are needed), as shown in FIG. 2. Then, the sample plate 40 is placed on a horizontal sample stand 15 provided in the ionization chamber 10. Hereinafter, each of the spots on the sample plate 40, at which the mixture is applied, is referred to as a sample spot 41.

A laser beam for ionizing the sample is emitted from a laser light source 50, reflected on a reflection mirror 51, passes through a window 21 on the top wall of the analysis chamber 20, penetrates the analysis chamber 20, and enters the ionization chamber 10 through the gate valve 30 that is opened. The sample stand 15 on which the sample plate 40 is placed is movable in the horizontal direction (in the directions along the X axis and the Y axis, in FIG. 2) by an XY stage 16 driven by a motor or the like. Accordingly, the sample spot 41 containing a target sample to be analyzed can be moved to a laser-irradiation position (the position indicated with the letter P in FIG. 2).

Inside the analysis chamber 20, extraction electrode 22 is disposed opposite to the top face of the sample plate 40 on the sample stand 15. The extraction electrode 22 forms an electric field for taking upward ions generated from the sample spot 41 placed on the laser-beam irradiation position P, from the vicinity of the generated position. The ions generated from the sample spot 41 by the irradiation with the laser beam are taken out of the ionization chamber 10 by the extraction electrode 22 toward the analysis chamber 20. The movement course of the ions is bent by an ion-transport optical system 23, so that the ions are introduced in an ion trap 24. The ion-transport optical system 23 includes four rod-shaped electrodes 23*a* to 23*d* extending in the direction perpendicular to the sheet of FIG. 1. The voltage to be applied to each of the electrodes 23*a* to 23*d* is controlled, thereby bending the movement course of the ions entering a space surrounded by these electrodes, to a direction substantially perpendicular to the course.

The ion trap 24 includes a single annular ring electrode 24*a*, an inlet-side endcap electrode 24*b*, and an outlet-side endcap electrode 24*c*. The inlet-side endcap electrode 24*b* and the outlet-side endcap electrode 24*c* are disposed opposite to each other across the ring electrode 24*a*. The inlet-side endcap electrode 24*b* has an ion injection port drilled at substantially the center of the inlet-side endcap electrode 24*b*, whereas the outlet-side endcap 24*c* has an ion ejection port drilled at substantially the center of the outlet-side endcap electrode 24*c*. The space surrounded by the ring electrode 24*a* and the endcap electrodes 24*b* and 24*c* is the ion trap space. The voltages to be applied to the respective three electrodes 24*a* to 24*c* are controlled, thereby trapping ions in the ion trap 24, and selectively discharging ions having the predetermined mass-to-charge ratio, from the ion trap 24.

The ions, the movement course of which is bent by the ion-transport optical system 23, enter in the ion trap 24 through the ion injection port of the inlet-side endcap electrode 24*b*, and are trapped in the ion trap space to be provisionally accumulated. Then, the voltage applied to each of the electrodes 24*a* to 24*c* is appropriately controlled, thereby causing the ions having the predetermined mass-to-charge ratio to be discharged through the ion ejection port of the outlet-side endcap electrode 24*c*, and to be detected in a detector 25. At this time, the voltage applied to each of the electrodes 24*a* to 24*c* is temporally varied, so that the mass-to-charge ratio of the ions which are discharged from the ion trap 24 and sent to the detector can be scanned.

The detector 25 includes a conversion dynode 25*a* and a secondary electron multiplier tube 25*b*. The ions discharged from the ion trap 24 are converted to electrons by the conversion dynode 25*a*, and the electrons are multiplied by the secondary electron multiplier tube 25*b*, and are then detected.

The secondary electron multiplier tube 25*b* sequentially outputs detection signals in response to the amount of the injected ions at each of the time points, to a data processing section (not shown). The data processing section that received the detection signals converts each of the time points to the mass-to-charge ratio, and creates mass spectra with the mass-to-charge ratios in the horizontal axis and the relative intensities in the vertical axis.

When the mass spectrometry of a single sample is completed with the aforementioned processes, the sample stand 15 is moved to allow the sample spot 41 containing the next target sample to be placed at the laser-beam irradiation position P. Thus, the mass spectrometry is performed in the same way. Such operations are repeated, thereby performing the mass spectrometry on the multiple samples on the sample plate 40.

Figure 3:
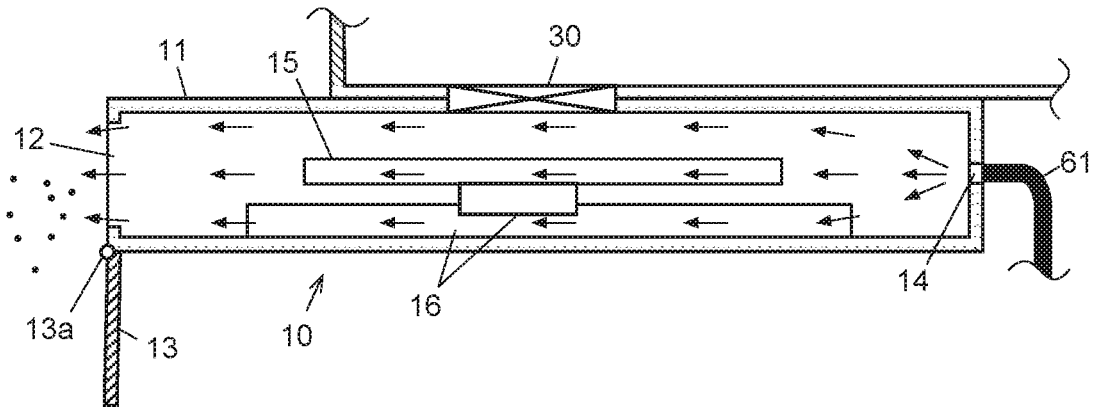
FIG. 3 is a vertical section view of an ionization chamber according to the embodiment.
Figure 4:
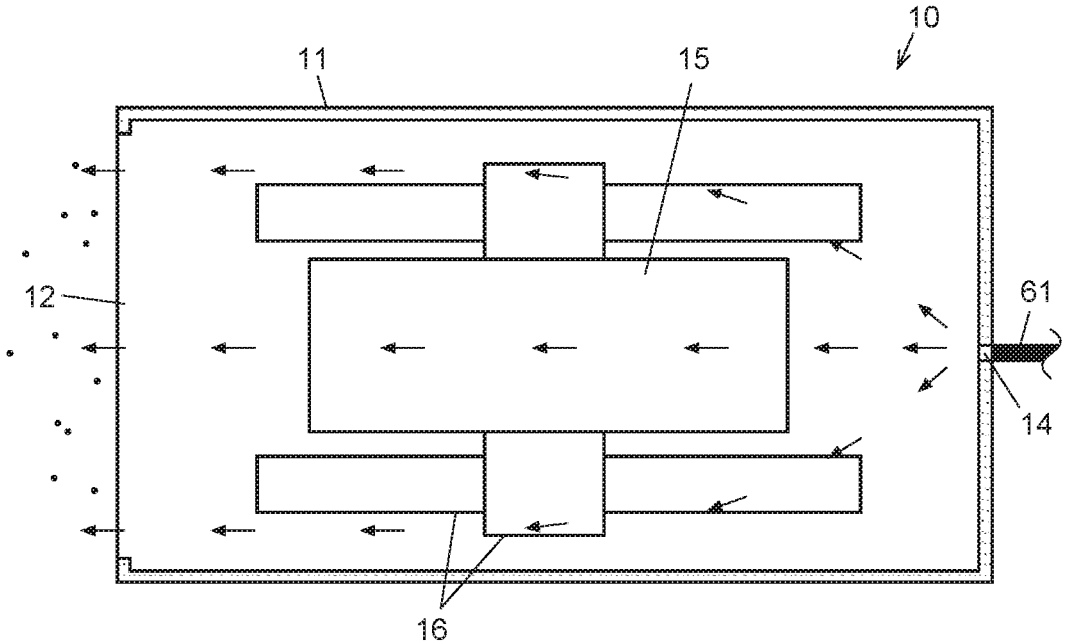
FIG. 4 is a horizontal section view of the ionization chamber according to the embodiment.

The configuration of the ionization chamber, which is a feature of the present invention, is described hereinafter, with reference to FIGS. 1, 3, and 4. The ionization chamber 10 has the sample stand 15 and the XY stage 16 for moving the sample stand 15 in the horizontal direction, which are provided inside the housing 11. It is preferable that the housing 11 according to the present embodiment has a thin rectangular parallelepiped shape, i.e., the inner size in the vertical direction (the direction of the Z axis in the drawings) is smaller (more preferably half or less, and much more preferably one third or less) than the smaller one of the inner size in the lateral direction (the direction of the X axis in the drawings) and the inner size in the front-back direction (the direction of the Y axis in the drawings). As such, the housing 11 contains the sample plate 40 extending along the XY plane, the sample stand 15, and the XY stage 16, while the capacity of the housing 11 can be minimized. Accordingly, the time required for the evacuation of the ionization chamber can be reduced. In addition, the housing 11 has such a thin shape, thereby efficiently removing the particles remaining inside the ionization chamber 10 (the details will be described later).

The housing 11 has a side wall on which a plate gateway 12 is provided for taking the sample plate 40 in and out of the housing 11. The plate gateway 12 has the size that is substantially the same as the size of the side wall. The plate gateway 12 is provided with a door 13 that is pivotably fixed to one of the sides of the plate gateway 12 via a hinge 13*a*. The door 13 has, on its exterior, a handle (not shown). A user holds the handle to manually open and close the door 13. The housing 11 has another side wall opposite to the plate gateway 12, on which a ventilation port 14 is provided. The ventilation port 14 is connected to one end of a common pipe 61. The common pipe 61 has the other end that is connected to a switch valve 62 to which one end of a first pipe 63, one end of a second pipe 64, and one end of a third pipe 65 are further connected. The first pipe 63 has its other end that is connected to a vacuum pump 66, the second pipe 64 has its other end that is connected to a gas cylinder 67, and the third pipe 65 has its other end that is opened. The gas cylinder 67 is filled with, for example, nitrogen gas or air, as cleaning gas. In the present embodiment, the plate gateway 12 corresponds to an opening part of the present invention; the switch valve 62 corresponds to a switch section of the present invention; and the gas cylinder 67 and the second pipe 64 correspond to a gas supplier of the present invention.

When the sample plate 40 is set inside the ionization chamber 10 in the mass spectrometer according to the present embodiment, the gate valve 30 between the analysis chamber 20 and the ionization chamber 10 is first closed, and a user manually switches the switch valve 62 to connect the common pipe 61 to the third pipe 65, so as to open the ionization chamber 10 to the air. Subsequently, the user manually opens the door 13, places the sample plate 40 on the top face of the sample stand 15 inside the ionization chamber 10, and then closes the door 13. Thereafter, the switch valve 62 is switched for connecting the common pipe 61 to the first pipe 63, so as to allow the inside of the ionization chamber 10 to be evacuated by the vacuum pump 66. When the inside of the ionization chamber 10 reaches the predetermined vacuum level, the gate valve 30 between the analysis chamber 20 and the ionization chamber 10 is opened, and the sample plate 40 is irradiated with a laser beam to ionize the sample, so as to perform the separation and detection of the generated ions by the mass-to-charge ratio.

The sample plate 40 is moved within the XY plane by the XY stage 16 while being irradiated with the laser beam. When the measurement of all sample spots on the sample plate 40 is completed, the user opens the ionization chamber 10 to the air by the processes identical to those mentioned before, and opens the door 13 to take out the sample plate 40 from the ionization chamber 10.

Thereafter, if the inside of the ionization chamber 10 is cleaned, the user switches the switch valve 62 to connect the common pipe 61 to the second pipe 64 in the state where the door 13 is opened. Accordingly, the cleaning gas in the gas cylinder 67 blows into the ionization chamber 10 from the ventilation port 14, passes through the ionization chamber as indicated by the arrows in FIGS. 3 and 4, and exits the ionization chamber 10 through the plate gateway 12. At this time, particles including fragments of the bacterial cells, which are left on the floor of the ionization chamber 10, are blown off due to the flow of the cleaning gas, and discharged from the ionization chamber 10 with the flow of the cleaning gas. Particles floating near the floor of the ionization chamber 10 are also swept away by the flow of the cleaning gas, and discharged from the ionization chamber 10.

As mentioned earlier, according to the mass spectrometer of the present embodiment, fragments of the bacterial cells and the like remaining in the ionization chamber 10 can be removed without disassembling the apparatus. Furthermore, according to the mass spectrometer of the present embodiment, the housing 11 of the ionization chamber 10 has such a thin shape as mentioned earlier. Thus, when the cleaning gas is introduced in the ionization chamber 10, the ratio of the gas passing through an area near the floor increases, thereby more efficiently removing the particles existing on and above the floor.

Figure 5:
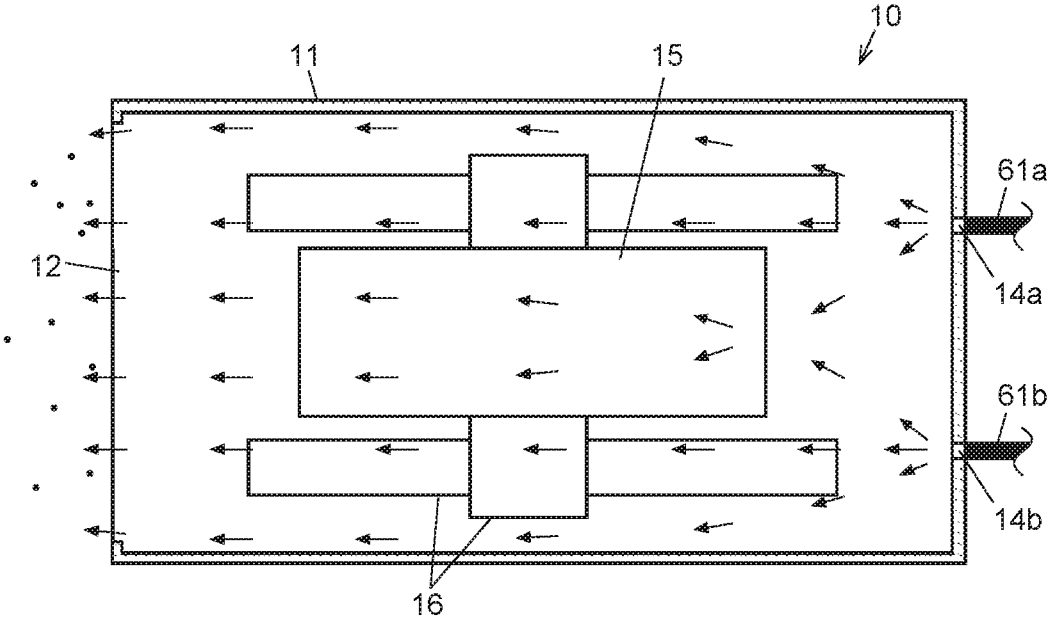
FIG. 5 is a diagram showing another configuration example of the ionization chamber according to the present invention.

Although the embodiment for practicing the present invention is described with examples, the present invention is not limited to the aforementioned examples, and appropriate changes in the scope of the present invention are acceptable. For example, though only a single ventilation port for introducing the cleaning gas into the ionization chamber 10 is provided in the aforementioned embodiment, two or more such ventilation ports may be provided in the mass spectrometer according to the present invention. FIG. 5 shows an example of the configuration of the ionization chamber 10 in such a mass spectrometer. In this example, two ventilation ports 14*a* and 14*b* are separated from each other with the predetermined distance on a wall of the ionization chamber 10, which is opposite to the plate gateway 12. In the configuration, one end of the common pipe 61 is divided into two branches. One of the branches (reference sign 61*a* in FIG. 5) is connected to the ventilation port 14*a*, whereas the other end (reference sign 61*b* in FIG. 5) is connected to the ventilation port 14*b*. According to such a configuration, the cleaning gas can be spread more uniformly in the horizontal direction, than the configuration in which only a single ventilation port is provided. Accordingly, particles can be removed more efficiently.

Figure 6:
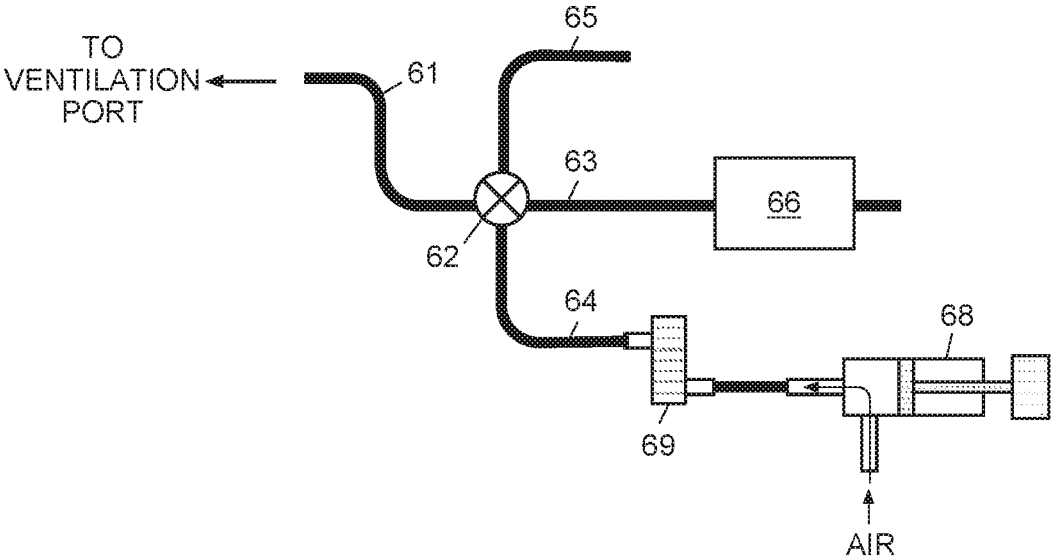
FIG. 6 is a diagram showing another configuration example of a gas supplier according to the present invention.

Furthermore, it is merely required for the gas supplier according to the present invention, for example, to introduce the cleaning gas into the ionization chamber at the positive pressure. Thus, the gas supplier of the present invention is not limited to those supplying the cleaning gas from the gas cylinder as in the embodiment mentioned earlier, but can be used for supplying the cleaning gas by, for example, a pump. FIG. 6 shows an example of the gas supplier provided with a pump. In this example, the air compressed by a plunger pump 68 is introduced in the ionization chamber 10 (i.e., the plunger pump 68 and the second pipe 64 correspond to the gas supplier in the present invention). If atmospheric moisture flows into the ionization chamber 10, much time is required for the subsequent evacuation of the ionization chamber 10. Accordingly, it is preferable to place a dehumidifying filter 69 in the downstream area of the plunger pump 68, for removing the atmospheric moisture.

Figure 7:
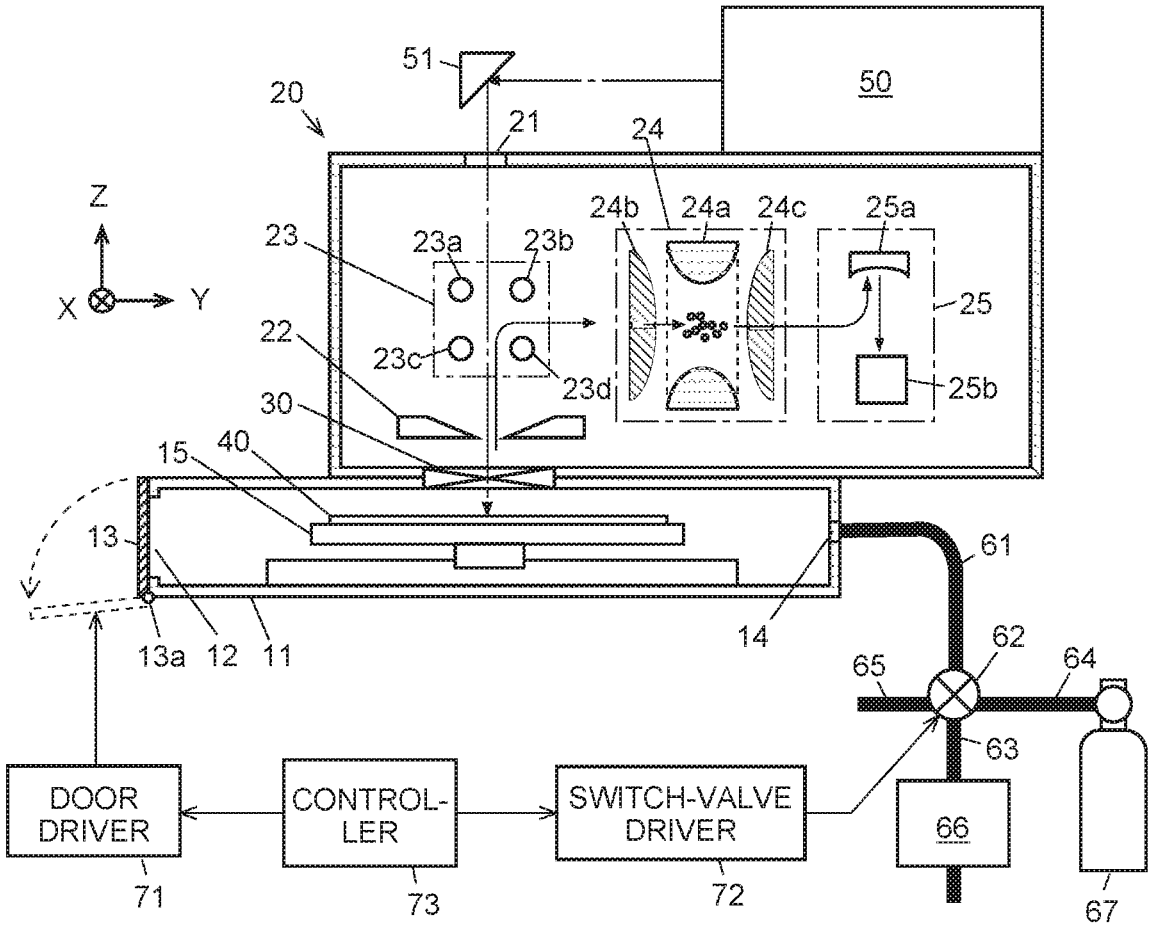
FIG. 7 is a diagram showing the entire configuration of a mass spectrometer according to another embodiment of the present invention.

Although the opening and closing of the door 13 and the switching of the switch valve 62 are manually conducted by a user in the embodiment mentioned earlier, these may be automatically conducted by the apparatus. FIG. 7 shows an example of the configuration in such a case. It should be noted that structural elements in FIG. 7 which are the same as or correspond to those in FIG. 1 are allocated with the same reference signs, and the description of those elements is omitted. A mass spectrometer shown in FIG. 7 includes a door driver 71 and a switch-valve driver 72 each including a motor and the like, and in addition, includes a controller 73 for controlling these drivers 71 and 72. In the mass spectrometer, the controller 73 controls the door driver 71 to open the door 13 of the plate gateway 12 at the predetermined timing or the time when a user issues a command to clean the ionization chamber. Men, the controller 73 controls the Switch-valve driver 72 to connect the common pipe 61 to the second pipe 64. With this, the high-pressure cleaning gas passes through the ionization chamber 10, and thus particles inside the ionization chamber 10 are removed along with the flow of the cleaning gas.

To the opening part 14, only the pipe (the second pipe 64) for supplying the cleaning gas to the ionization chamber 10 may be connected. The pipe that reaches the vacuum pump 66, the pipes for opening the chamber to the air (i.e., the common pipe 61, the first pipe 63, and the third pipe 65), and the switch valve 62 may be connected to an opening part formed on a wall of the ionization chamber 10, in addition to the opening part 14. In this case as well, the other end of the pipe 64 for supplying the cleaning gas to the ionization chamber is connected to the gas cylinder 67 filled with the cleaning gas. In such a case, an opening/closing valve is provided on the pipe 64, and the opening/closing valve and the door driver 71 are controlled by the controller 73, thereby inter-connectedly operating the opening and closing of the door 13 and the supply and suspension of the supply of the cleaning gas (in this case, the gas cylinder 67, pipe 64, and opening/closing valve correspond to the gas supplier in the present invention). The plunger pump 68 mentioned earlier may be connected to the other end of the pipe 64, instead of providing the gas cylinder 67 and the opening/closing valve (in this case, the plunger pump 68 and the pipe 64 correspond to the gas supplier in the present invention). In such a configuration, the plunger pump 68 and the door driver 71 are controlled by the controller 73, thereby interconnectedly operating the opening and closing of the door 13 and the supply and suspension of the supply of the cleaning gas.

REFERENCE SIGNS LIST

10 . . . Ionization Chamber
11 . . . Housing
12 . . . Plate Gateway
13 . . . Door
13*a* . . . Hinge
14 . . . Ventilation Port
15 . . . Sample Stand
16 . . . XY Stage
20 . . . Analysis Chamber
21 . . . Window
22 . . . Extraction Electrode
23 . . . Ion-Transport Optical System
24 . . . Ion Trap
25 . . . Detector
30 . . . Gate Valve
40 . . . Sample Plate
41 . . . Sample Spot
50 . . . Laser Light Source
61 . . . Common Pipe
62 . . . Switch Valve
63 . . . First Pipe
64 . . . Second Pipe
65 . . . Third Pipe
66 . . . Vacuum Pump
67 . . . Gas Cylinder
68 . . . Plunger Pump
69 . . . Dehumidifying Filter
71 . . . Door Driver
72 . . . Switch-Valve Driver
73 . . . Controller

The invention claimed is:

1. A mass spectrometer comprising:

an ionization chamber with a floor and a plurality of side walls, in which ionization is performed on a sample by laser ionization;

an opening part provided on any one of the plurality of side walls of the ionization chamber, the opening part including a door, the one of the plurality of sidewalls on which the opening part is provided having a height in a vertical direction;

a ventilation port provided on another one of the plurality of side walls of the ionization chamber, the another one being opposite to the opening part;

a gas supplier configured to supply high-pressure gas to an inside of the ionization chamber through the ventilation port;

a vacuum pump configured to evacuate the ionization chamber, wherein:

the opening part is a plate gateway for taking a sample plate, to which the sample is applied, in and out of the ionization chamber, the plate gateway having a height in the vertical direction;

the height of the plate gateway is substantially the same as the height of the one of the plurality of side walls on which the opening part is provided so that particles existing on or near the floor of the ionization chamber are swept out of the ionization chamber through the opening part by the high-pressure gas; and the ionization chamber has a rectangular parallelepiped shape in which an inner size in the vertical direction is one third or less than the smaller one of the inner size in the lateral direction and the inner size in the front-back direction.

2. The mass spectrometer according to claim 1, further comprising:

a switch section configured to switch states including a state where the vacuum pump communicates with the ionization chamber through the ventilation port and a state where the gas supplier communicates with the ionization chamber through the ventilation port.

3. The mass spectrometer according to claim 2, further comprising:

a door driver configured to open and close the door; and a controller configured to control the door driver and the switch section so that the high-pressure gas is supplied by the gas supplier in a state where the door is opened.

4. The mass spectrometer according to claim 1, further comprising a door driver configured to open and close the door; and a controller configured to control the door driver and the gas supplier so that the high-pressure gas is supplied by the gas supplier in a state where the door is opened.

5. The mass spectrometer according to claim 1, further comprising an analysis chamber, wherein a gate valve is provided between the ionization chamber and the analysis chamber at a top surface of the ionization chamber; and the one of the plurality of side walls including the opening part extends in the vertical direction.

6. The mass spectrometer according to claim 1, wherein the sample plate is provided directly between the opening part and the ventilation port.

7. The mass spectrometer according to claim 1, further comprising a handle on the exterior surface of the door, wherein the handle is configured to allow a user to manually open and close the door.

* * * * *